US011284718B1

(12) United States Patent
Schneider

(10) Patent No.: US 11,284,718 B1
(45) Date of Patent: Mar. 29, 2022

(54) COUPLED BOOKCASE ARRANGEMENT WITH PERIPHERAL FRAME

(71) Applicant: Eric Michael Schneider, Tucson, AZ (US)

(72) Inventor: Eric Michael Schneider, Tucson, AZ (US)

( * ) Notice: Subject to any disclaimer, the term of this patent is extended or adjusted under 35 U.S.C. 154(b) by 0 days.

(21) Appl. No.: 17/360,188

(22) Filed: Jun. 28, 2021

(51) Int. Cl.
*A47B 87/00* (2006.01)
*A47B 63/00* (2006.01)
*A47B 96/14* (2006.01)

(52) U.S. Cl.
CPC ..... *A47B 87/008* (2013.01); *A47B 63/00* (2013.01); *A47B 87/005* (2013.01); *A47B 96/1441* (2013.01)

(58) Field of Classification Search
CPC ..... A47B 63/00; A47B 96/14; A47B 96/1441; A47B 2220/0019; A47B 87/005; A47B 87/007; A47B 87/008; A47F 5/08; B65D 7/44; B65D 7/48
USPC ..... 312/45; 211/42; 220/648, 650, 654
See application file for complete search history.

(56) References Cited

U.S. PATENT DOCUMENTS 640,315 A * 1/1900 Parmelee ..... B65D 25/04 217/8
927,379 A * 7/1909 Points ..... A47B 63/00 312/352
1,161,409 A * 11/1915 Peckham ..... B65D 7/48 220/640
1,612,563 A * 12/1926 Bellis ..... A47B 63/00 211/131.2
1,658,287 A * 2/1928 Debus ..... B65D 7/44 217/69
3,035,803 A * 5/1962 Miller ..... A47F 5/08 248/313
3,343,899 A * 9/1967 Cousins ..... A47B 87/008 248/74.2
3,494,685 A * 2/1970 Fiterman ..... A47B 87/02 312/108
4,145,100 A * 3/1979 Klaus ..... B42F 17/08 211/11

(Continued)

FOREIGN PATENT DOCUMENTS

CA 2534498 A1 * 8/2006 ..... A47B 63/00
CN 108720341 A * 11/2018

(Continued)

OTHER PUBLICATIONS

Translation for DE 2723569 A1. (Year: 1978).*

(Continued)

*Primary Examiner* — Michael Safavi
(74) *Attorney, Agent, or Firm* — Quarles & Brady LLP; Yakov Sidorin

(57) ABSTRACT

Structures and methods of fabrication for articles of furniture that include generalized sideway-disposed containers and outside frames configured to maintain the structural integrity of such containers, to prevent and/or avoid problems of deformation of the furniture piece that carries a weight-load, especially deformation caused by lack of support of such article from the bottom. The frame is juxtaposed (Continued)

with at least two outside surfaces of the piece of furniture article along the lengths of such surfaces.

18 Claims, 9 Drawing Sheets

(56) References Cited

U.S. PATENT DOCUMENTS

| | | | | | |
|---|---|---|---|---|---|
| 4,295,692 | A * | 10/1981 | Jenkins | A47L 15/4246 | 134/200 |
| 4,669,627 | A * | 6/1987 | Ueda | A47G 23/0258 | 220/648 |
| 5,211,293 | A * | 5/1993 | Rossmoore | A47F 7/144 | 211/42 |
| 5,301,820 | A * | 4/1994 | Rossmoore | A47F 7/144 | 211/134 |
| 8,147,009 | B1 * | 4/2012 | Rider | A47B 47/00 | 312/257.1 |
| 2011/0241505 | A1 * | 10/2011 | Tashjian | A47B 87/0276 | 312/198 |
| 2013/0186844 | A1 * | 7/2013 | Lupo | A47B 87/008 | 211/42 |
| 2013/0256253 | A1 * | 10/2013 | Stuby | A47B 87/005 | 211/186 |

FOREIGN PATENT DOCUMENTS

| | | | | | |
|---|---|---|---|---|---|
| CN | 112220240 | A * | 1/2021 | | |
| DE | 2723569 | A1 * | 11/1978 | A47F 5/00 | |
| DE | 3106310 | A1 * | 9/1982 | A47B 77/02 | |
| DE | 19605893 | A1 * | 8/1997 | A47B 87/005 | |
| DE | 102011106915 | A1 * | 12/2012 | A47B 47/0091 | |
| FR | 1503752 | A * | 12/1967 | B65D 25/04 | |
| FR | 2470562 | A1 * | 6/1981 | A47B 57/565 | |
| FR | 2746275 | A1 * | 9/1997 | A47B 87/005 | |
| GB | 1208657 | A * | 10/1970 | A47B 87/0246 | |
| KR | 20110008823 | U * | 9/2011 | A47B 47/00 | |
| KR | 2017059775 | A * | 5/2017 | | |
| KR | 2018086106 | A * | 7/2018 | | |
| WO | WO-2017151036 | A1 * | 9/2017 | F16B 12/34 | |
| WO | WO-2021034294 | A1 * | 2/2021 | A47B 96/02 | |

OTHER PUBLICATIONS

Translation forCN 108720341 A. (Year: 2018).*
Translation for DE 19605893 A1. (Year: 1997).*
Translation for KR 2017059775 A. (Year: 2017).*

* cited by examiner

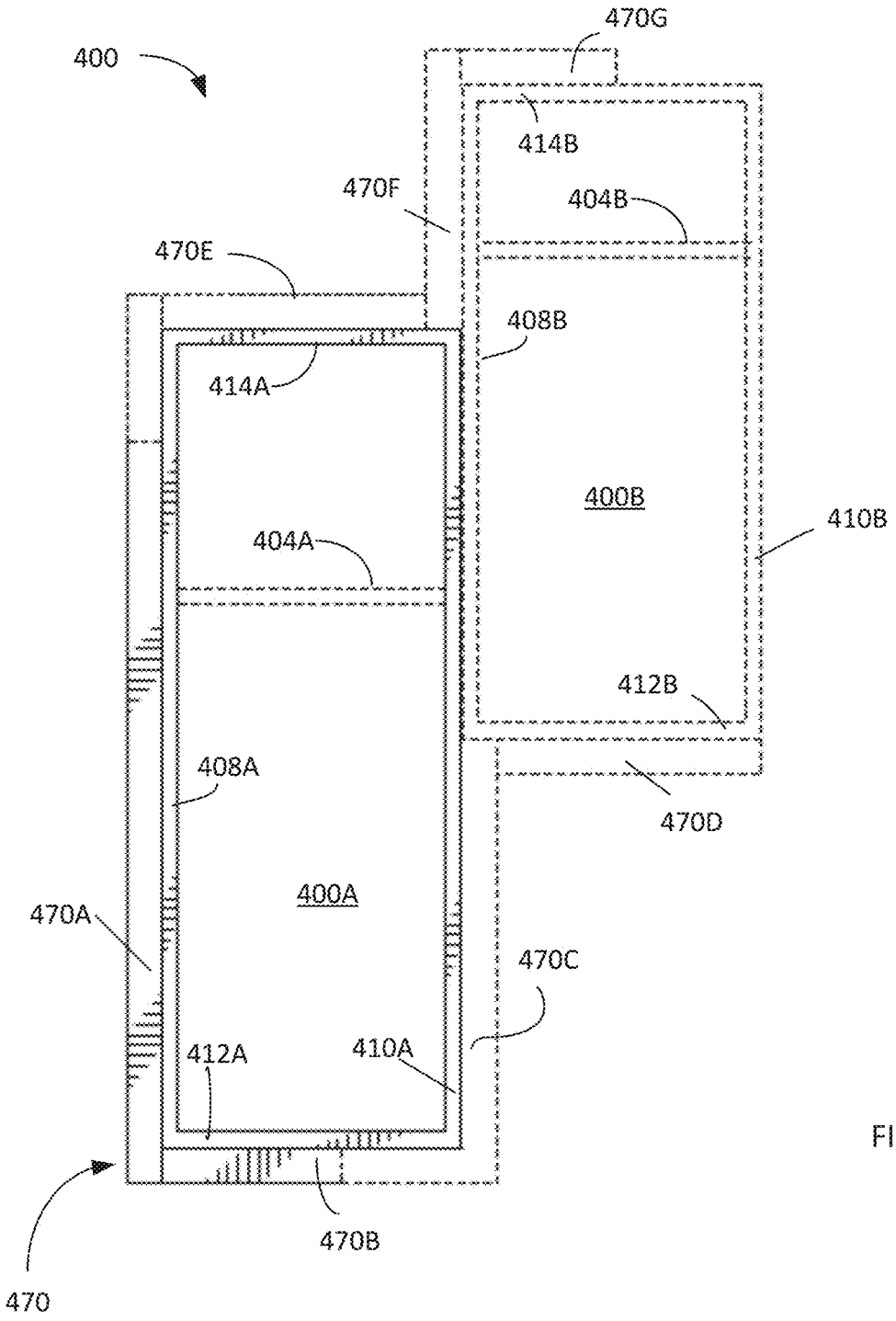
FIG. 4A1

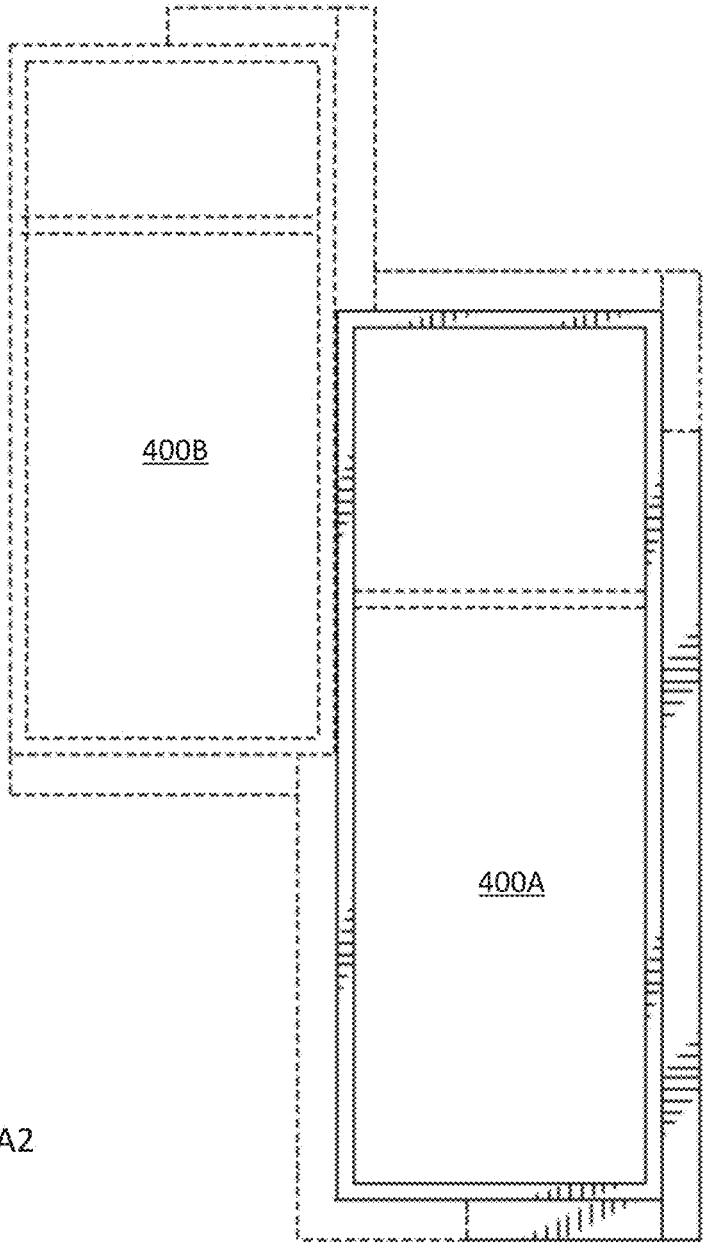
FIG. 4A2

COUPLED BOOKCASE ARRANGEMENT WITH PERIPHERAL FRAME

TECHNICAL FIELD

The present invention relates to furniture and, more particularly, to a piece configured as a container supported by a specifically-structured frame.

RELATED ART

Furniture comes in various incarnations—wardrobes, bookcases, cabinets, various stands—many of which include a portion that can be viewed, generally speaking, as a box or a container or a closed shelf positioned sideways (which ma include additional shelves and/or be optionally supported by some sort of a back panel). When the weight load, defined by contents of such container portion, exceeds certain limits imposed by the geometry of the sidewalls and other carrying elements of the container (as well as—often frequently—composite materials used for the construction of the container portion), such container or shelf deforms, its walls bow out, and its integrity can be detrimentally affected. A common example of this situation is familiar to almost everyone: it is provided by a bookcase—especially the one hanging on a wall. Conventional solutions to strengthening such a piece of furniture (including using internal fixtures and fasteners and/or use of strong material such as natural wood) typically have trade-offs, the most typical of which is cost. Moreover, in the case of a hanging on a wall bookcase—especially when such a bookcase is structured in a non-traditional fashion, for example when the bookcase includes multiple adjoining containers of different sizes—such solutions are well known to fall short of addressing the problem, particularly with respect to the deformation of bottom panel(s) of the bookcase.

SUMMARY

An embodiment of the present invention provides a piece of furniture that includes a container formed by first and second sidewall panels, a main top panel connecting the first and second sidewall panels and defining a top dihedral angle with the first sidewall panel, and a main bottom panel connecting the first and second sidewall panels and defining a bottom dihedral angle with the first sidewall panel. The piece of furniture additionally includes a frame containing first and second beams connected to one another at first ends of such beams at the bottom dihedral angle with one another, while each of these first and second beams has a corresponding axis and a corresponding polygonal cross-section. In at least one case, the frame may be attached to the container such that the first beam is affixed to the first sidewall panel at at least one point along a length of the first beam and the second beam is affixed to the main bottom panel at at least one point along a length of the second beam. Alternatively or in addition, at least one of the first sidewall panel and the main bottom panel has a substantially rectangular outer surface and a corresponding one of the first and second beams is attached to such substantially rectangular outer surface diagonally. The frame may further include a third beam connected to a second end of the first beam and forming the top dihedral angle with the first beam; and/or the frame may be attached to the container such that the first beam is affixed to the first sidewall panel at at least one point along a length of the first beam (here, the second beam is affixed to the bottom panel at at least one point along a length of the second beam, and the third beam is affixed to the top panel at at least one point along a length of the third beam). In the latter case, the third and second beams are substantially tangentially parallel to one another and/or axes of the third and second beams are parallel to one another. In at least one implementation, the piece of furniture is configured to satisfy at least one of the following conditions: the first and second sidewall panels are substantially parallel to one another; the main top panel and the main bottom panel are substantially parallel to one another; a cross-section of at least one of the first and second beams is a quadrilateral; such cross-section is a parallelogram; and the first and second beams are attached to outside surfaces of the container. Alternatively or in addition, an implementation of the piece of furniture may be configured to satisfy at least one of the following conditions: the container is a bookcase; the container includes a shelf disposed along the top panel substantially transversely between the first and second sidewall panels; the container includes a rear wall connecting at least two of first and second sidewall panels, the main bottom panel, and the main top panel; and the container and at least one of the first and second beams are made of different materials. In at least one case the container may be structured to include a third side wall separated from the first sidewall panel by the second sidewall panel, and one or more of an auxiliary bottom panel (connecting the second sidewall panel with the third sidewall panel) and an auxiliary top panel (connecting the second sidewall panel with the third sidewall panel). In this latter case, the auxiliary bottom panel may be positioned to be separated from the main bottom panel along a second sidewall panel, while the frame may include a fourth beam and a fifth beam (with a first end of the fourth beam connected to a second end of the second beam and a first end of the fifth beam connected to a second end of the fourth beam) and/or—when the auxiliary bottom panel is separated from the main bottom panel—the frame may be attached to the container such that the fifth beam is affixed to auxiliary bottom panel substantially at at least one point along a length of the fifth beam, while the fourth beam is affixed to the container substantially at at least one point along a length of the fourth beam. Alternatively or in addition—when the auxiliary bottom panel and the main bottom panel lie in the same plane and the frame is attached to the container—the second beam may extend along the auxiliary bottom panel and is affixed to the auxiliary bottom panel at at least one point along a length of the second beam.

Embodiments of the invention additionally provide a method for manufacture of a piece of furniture. The method includes affixing a first beam (which has a first length and a first polygonal cross-section and a first axis, to and along a first sidewall panel at at least one point along the first length) and attaching a second beam (which has a second length and a second polygonal cross-section and a second axis) to and along a main bottom panel at at least one point along the second length. The method further includes a step of bringing ends of the first and second beams in contact with one another. The process of affixing may include affixing the first beam to the first sidewall panel of a container that is formed by the first sidewall panel, a second sidewall panel, the main bottom panel connecting the first and second sidewall panels, and a main top panel connecting the first and second sidewall panels and separated from the main bottom panel by the first and second sidewall panels. Alternatively or in addition, the process of attaching may include attaching the second beam to the main bottom panel of the container. In at least one implementation, the processes of affixing and attaching may involve the action of cooperating the first and second beams with an outside surface of a container (to form a first rib substantially in the middle of the first sidewall panel and a second rib substantially in a middle of the main bottom panel to increase a rigidity of the container); and/or the process of bringing the ends of the first and second beams together may include affixing the first and second beams to one another at a substantially right angle (whether before or after the processes of affixing and attaching as specified above). The first and second polygonal cross sections at the ends of the first and second beams may be substantially congruent with one another, and the step of bringing of such ends together may include affixing the first and second beams to one another along such first and second polygonal cross-sections.

BRIEF DESCRIPTION OF THE DRAWINGS

The invention will be more fully understood by referring to the following Detailed Description of Specific Embodiments in conjunction with the Drawings, of which:

FIGS. 4A1, 4A2, 4B, 4C, 4D, 4E, and 4F schematically illustrate an embodiment of the invention in front, back, left, right, top, bottom plan views and in a perspective view, respectively.

Generally, the sizes and relative scales of elements in Drawings may be set to be different from actual ones to appropriately facilitate simplicity, clarity, and understanding of the Drawings. For the same reason, not all elements present in one Drawing may necessarily be shown in another. Generally, unless specified otherwise, dimensions—if shown—are shown in mm.

DETAILED DESCRIPTION

In accordance with preferred embodiments of the present invention, structures and methods of fabrication are disclosed for articles of furniture that include generalized sideway-disposed containers and outside frames maintaining the structural integrity of such containers. Embodiments of the present invention address a simple but well-known and persisting problem of deformation of a furniture article that carries a weight-load, especially deformation caused by lack of support of such article from the bottom. The solution is provided by a frame juxtaposed with at least two outside surfaces of the furniture article. In a specific implementation—when the width of the frame is chosen to be smaller than the depth of the container that is configured to stand on the floor—such frame provides a so-called "toe-kicks". A person of skill in the art should readily appreciate that, while the following disclosure discusses the embodiments of the invention based on examples of various bookcases, a different article of furniture than includes a generalized container.

Figure 1A:
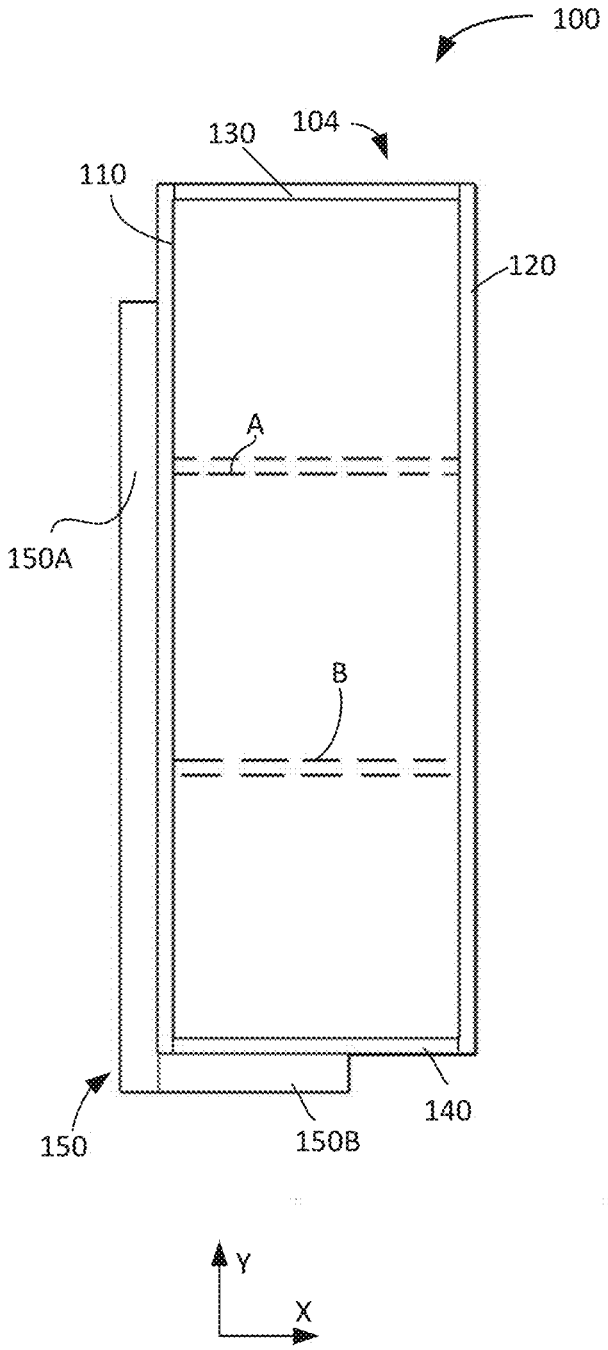
FIGS. 1A, 1B illustrate an embodiment of the article of furniture configured according to an idea of the invention in front and side views, respectively.
Figure 1B:
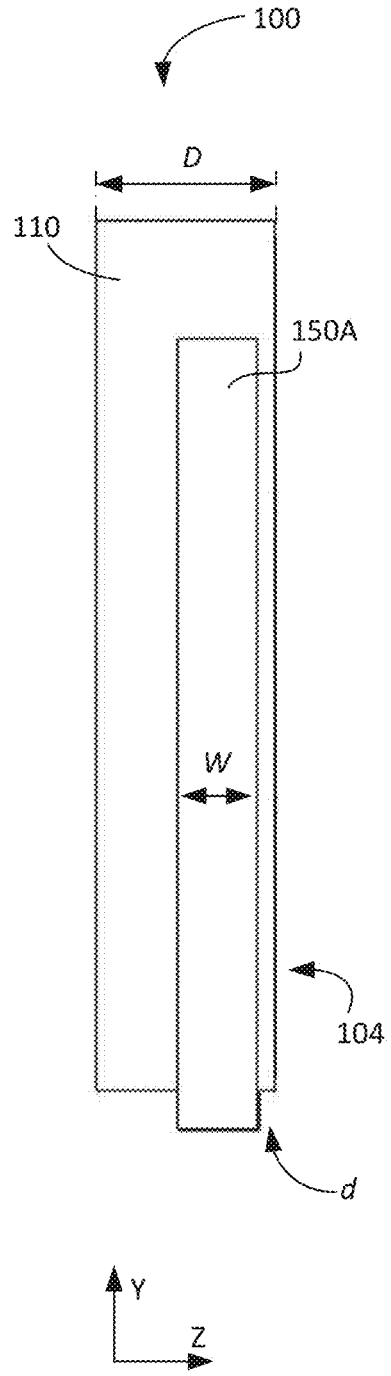

FIGS. 1A and 1B provide a simplified schematic—in front and side views—of a simple bookcase structured according to the idea of the invention. The embodiment 100 includes a piece of furniture 104 (shown as a vertically-positioned container formed with two sidewall panels 110, 120, a main top pane1130 and a main bottom panel 140) that main optionally include one or more shelves (indicated as two shelves, A and B, in this example). While the sidewall panels 110, 120 are shown to be substantially perpendicular to the mutually-parallel main top and bottom panels 130, 140, it is understood that these four container-forming panels can be affixed to one another to define a shape different from a parallelepiped—for example, a trapezoid (as viewed from the front).

The frame 150 is shown to include two rigid beams (~ frame portions) 150A, 150B, each of which is disposed along and in contact with the corresponding panel—as shown, the sidewall panel 110 and the main bottom panel 140, respectively, to define "ribs" across the corresponding panels. The beams 150A, 150B are connected and affixed to one another at first ends of these beams (as illustrated in the low left corner of FIG. 1A) at an angle substantially equal to an angle formed by the corresponding panels 110, 140 to form the frame maintaining the initial shape of the panels 110, 140 (here—planar panels).

Each beam of the frame 150 has a generally polygonally-shaped cross-section (in one case, with a quadrilateral cross section, in a specific implementation—a trapezoidal cross-section or a rectangular cross-section), and a length that is either substantially equal to a length of the corresponding panel such beam is supporting and/or affixed to, or shorter than such penal length. FIG. 1B illustrates the situation when the width of the frame 150—as shown, the width W of the beam 150A—is smaller than the depth D of the piece 104. When this is the case, and when the piece 104 is configured to stand on a floor, the frame 150 may generally be attached to the piece 104 such as to provide for a space d that may serve as a toe-kicks space when the embodiment 100 is designed to stand on the floor. Generally, the ratio of d/D may differ: the "rib" formed by the panel beam 150B across the bottom panel 140 may be positioned substantially in the middle, axial portion of the panel 140 or, alternatively, be shifted sideways (as shown in the example of FIG. 1B).

Figure 2B:
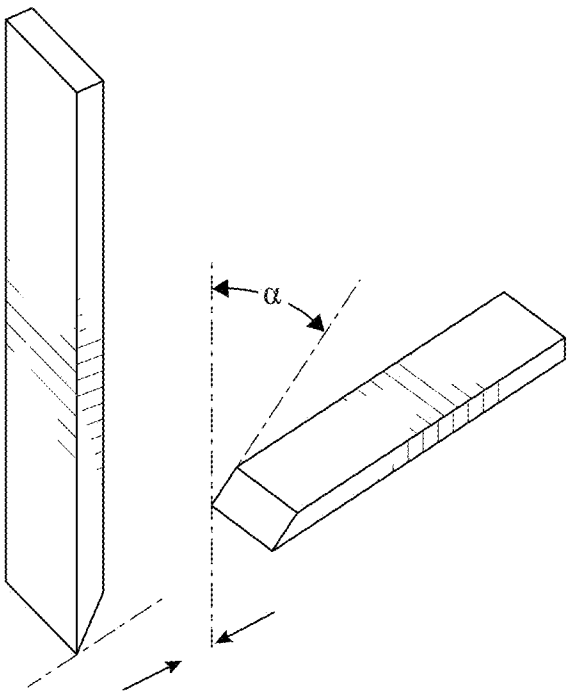
FIGS. 2A, 2B schematically show the options for cooperating with one another of constituent beam portions of a frame of an embodiment.
Figure 2A:
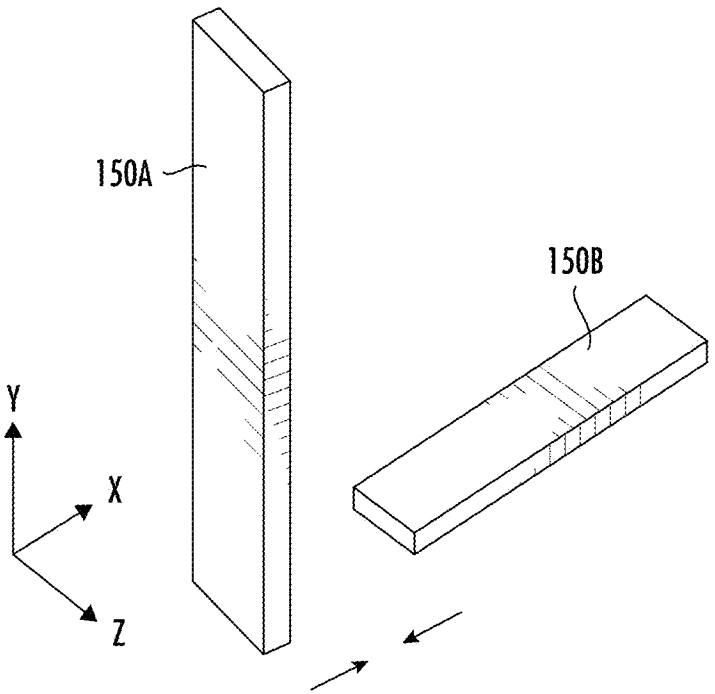

The attachment of the frame beams 150A, 150B (shown in FIG. 2A as having rectangular cross-sections) to one another can be carried our directly, by affixing a terminating edge surface of one of the beams to a side surface of another. In one case—illustrated in FIG. 2A—such terminating surfaces may be defined to be substantially perpendicular to the axes of the corresponding frame beams. In a related case, an end (specifically, a terminating surface) of each beam can be inclined at an angle with respect to an axis of such beam to form a tilted end facet (such as the tilted facets 150A1, 150B1 schematically illustrated in FIG. 2B to be terminated at angles ($90°-\alpha$) defined in reference to axes of the beams), in which case both of these tilted end facets are coupled with one another directly along the tilted terminating surfaces, by analogy with coupling of different pieces of a wall trim. Alternatively, the frame 150 can be formed as a unitary, single piece in which the beam portions 150A, 150B are simply not separable from one another. When affixed to the piece 100, the frame 150 provides structural support to the piece 100 substantially preventing the sidewall panel 110 from bending outwards and the main bottom panel 140 from bowing down (in case the embodiment 100 is hung on the supporting wall such as a wall of the room).

Figure 3A:
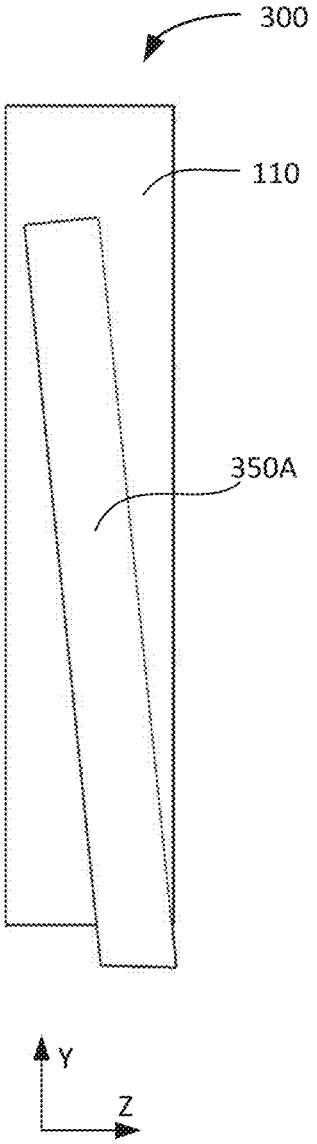
FIGS. 3A, 3B schematically illustrate examples of spatial cooperation between constituent beam portions of a frame of an embodiment with respectively corresponding panels of a given piece of furniture, in side and bottom views.
Figure 3B:
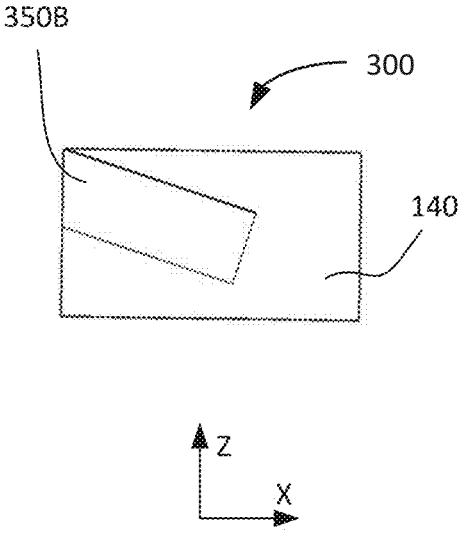

It is understood that the frame 150 does not have to be necessarily attached to the piece 104 such that axes of the beams 150A, 150B remain substantially parallel to the longitudinal extensions of the panels 110, 140. To this end, FIGS. 3A, 3B, for example, illustrate the related embodiment 300, in which at least one of the beams of the frame 350 is extended substantially diagonally along the corresponding panel. As shown, the beam 350A is extended along the diagonal of the sidewall panel 110, while the beam 350B tracks the diagonal of the main bottom panel 140.

Pieces of furniture that benefit from the idea of the invention also understandably include more complex forms—such as, in a specific non-limiting example, a bookcase that includes multiple container sections. One such case 400 is schematically illustrated in FIGS. 4A1, 4A2, 4B, 4C, 4D, 4E, and 4F (in various plan and perspective views). Notably, dashed lines in these Figures indicate optional elements—not the ones hidden from view. The constituent cases 400A, 400B (each of which may include at least one optional respective inner shelf 404A, 404B) are shown brought together and affixed to one another side-by-side (along the corresponding sidewalls 410A, 408B), and may have different dimensions. As a matter of a non-limiting example only, the sidewall panels 408B, 410B of the case 400B may be shorter than the sidewall panels 408A, 410A of the case 400A and, as a result, the auxiliary bottom panel 412B of the case 400B can be generally separated along the length of a sidewall panel from the main bottom panel 412A of the case 400A. The width of the constituent cases 400A, 400B can also be different (with a result that the lengths of the corresponding top panels 414A, 414B are not the same.

To implement the idea of the invention in this case, the frame 470 includes not only the beams 470A, 470B extending along the panels of the case 400A, but also may include the panel 470D disposed under and affixed to the auxiliary bottom panel 412B. In this case, the frame beams 470B and 470D may be cooperated with one another with the use of an intermediate beam 470C shown to extend along the sidewall panel 410A between the main bottom panel 412A and the auxiliary bottom panel 412B. Additionally, the frame 470 in the implementation 400 may be complemented by a frame beam 470E that extends along and in contact with the main top panel 414A, a frame beam 470F drawn along and in contact with a portion of the sidewall patent 408B, and even a frame beam 470G stretched above and in contact with the auxiliary top panel 414B. Preferably, each of the present (when present) frame beams 470A, 470B, 470C, 470D, 470E, 470F, 470G is rigidly connected to the immediately-adjacent neighboring frame beam to form a unified frame 470.

Figures 4B, 4C:
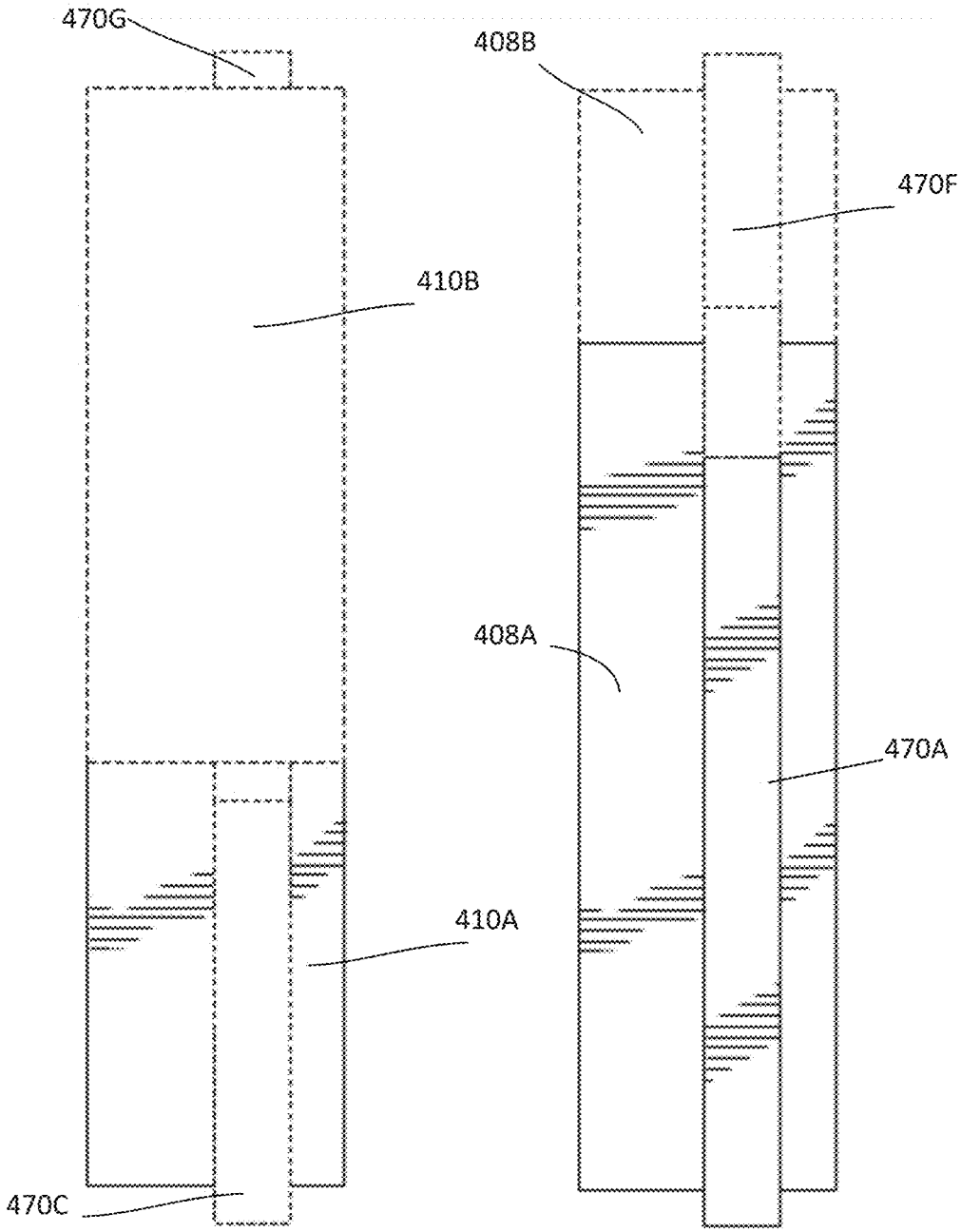
Figure 4D:
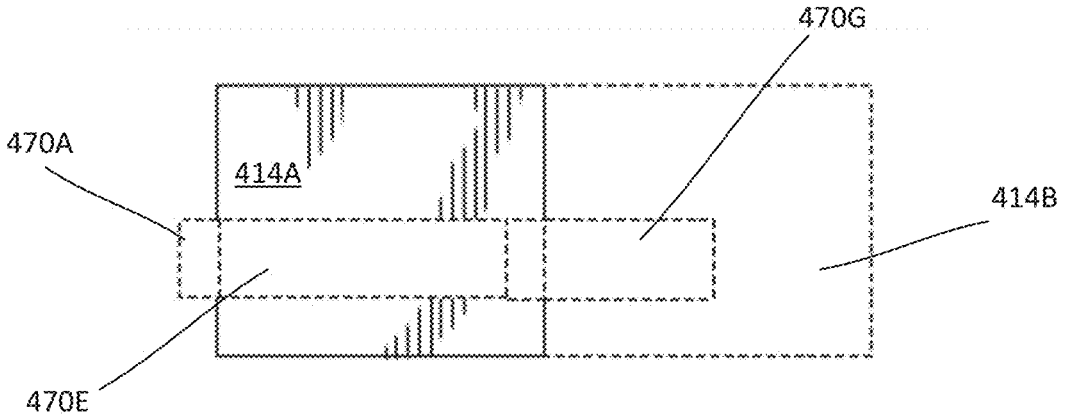
Figure 4E:
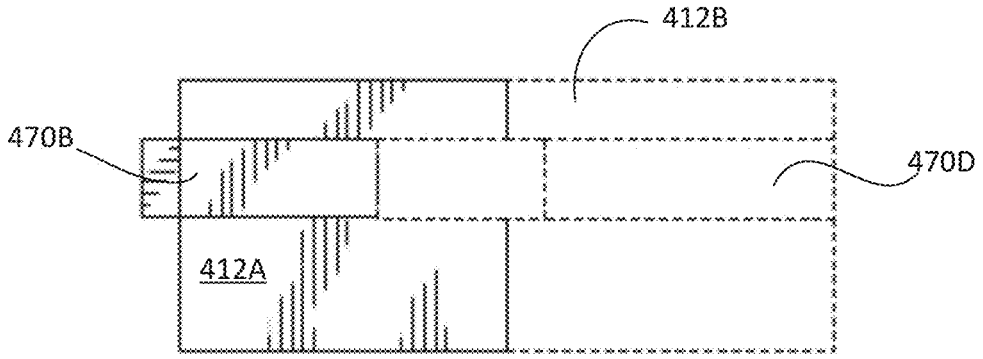
Figure 4F:
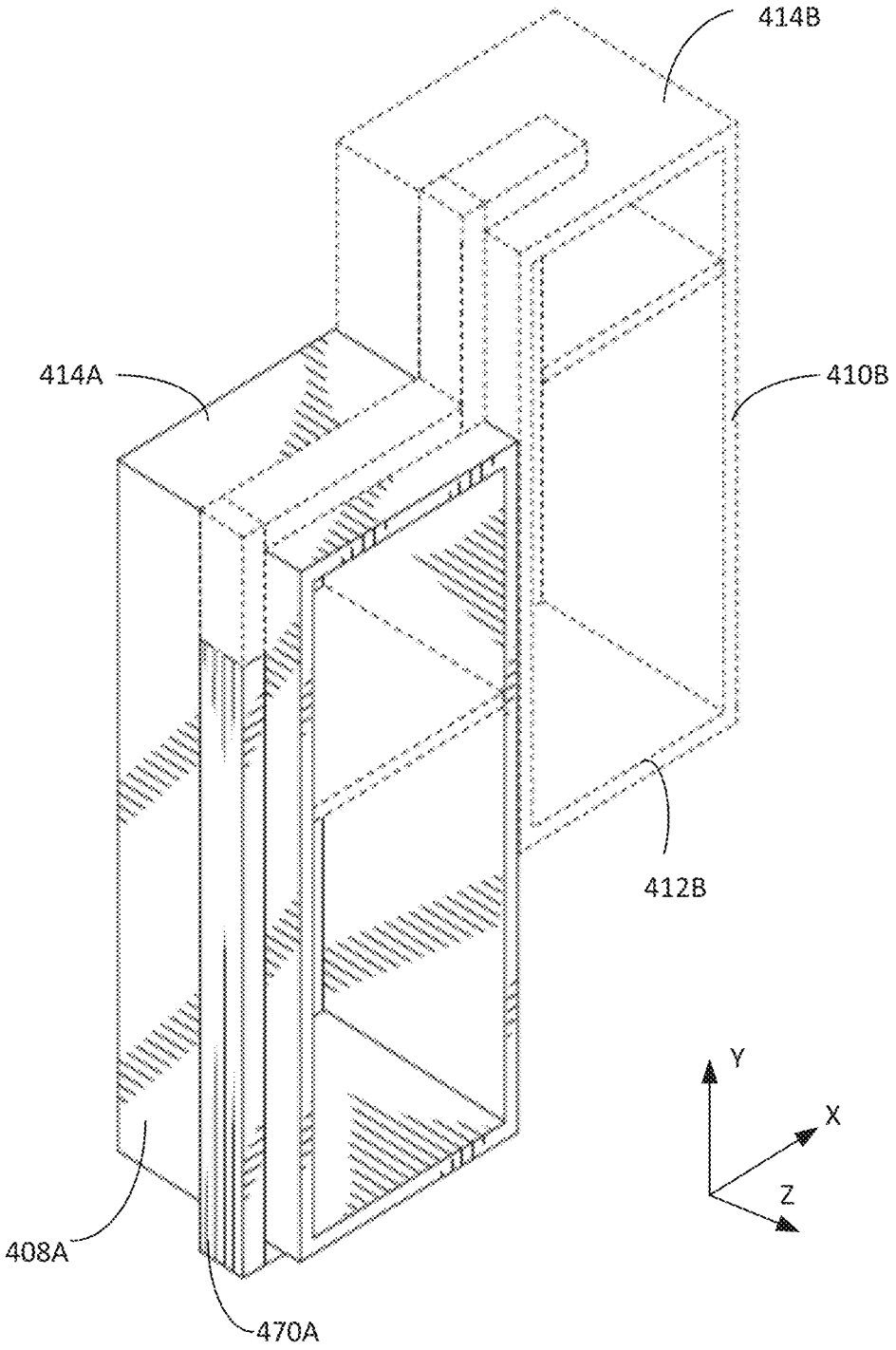

FIG. 4F presents the embodiment 400 in a perspective view from which a person of skill can better understand the structure of the embodiment.

As shown in FIGS. 4A through 4G, none of the constituent cases 400A, 400B has a back panel. When affixed to the piece 400, the frame 470 provides structural support to the piece 400 substantially preventing at least the sidewall panel 408A from bending outwards and the main bottom panel 470B from bowing down (in case the embodiment 400 is hung on the supporting wall such as a wall of the room) and/or supporting the constituent cases 400A, 400B in their juxtaposed with one another coupled arrangement. It is also understood that variations in the shape and positioning of the frame 470 and/or its constituent beams can be varied (for example, by analogy with that described in reference to FIGS. 2A, 2B, 3A, 3B).

Figure 5B:
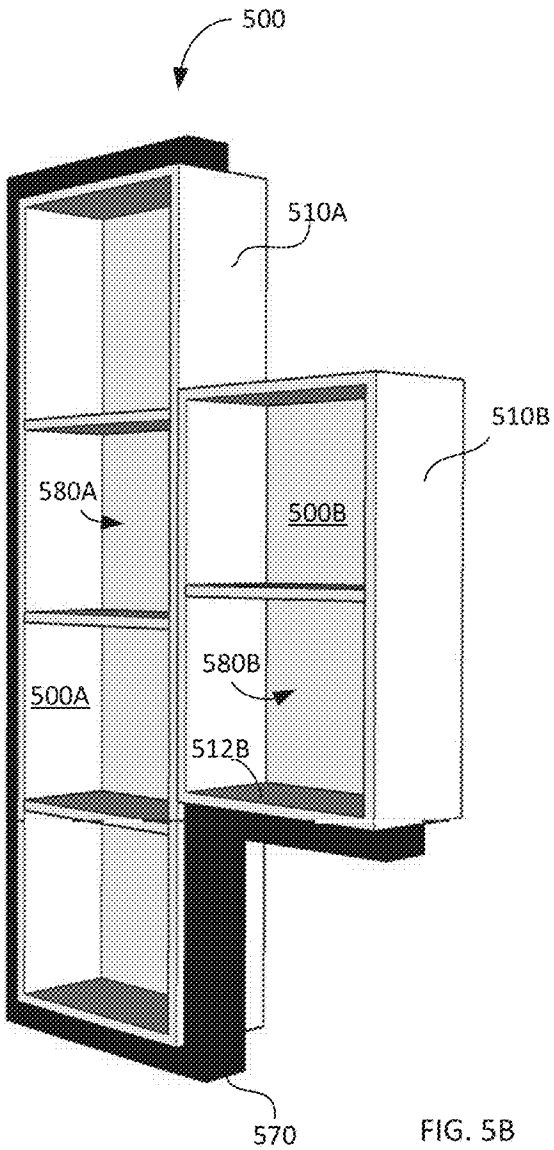
FIGS. 5A, 5B provide perspective views of a related implementation of the invention.
Figure 5A:
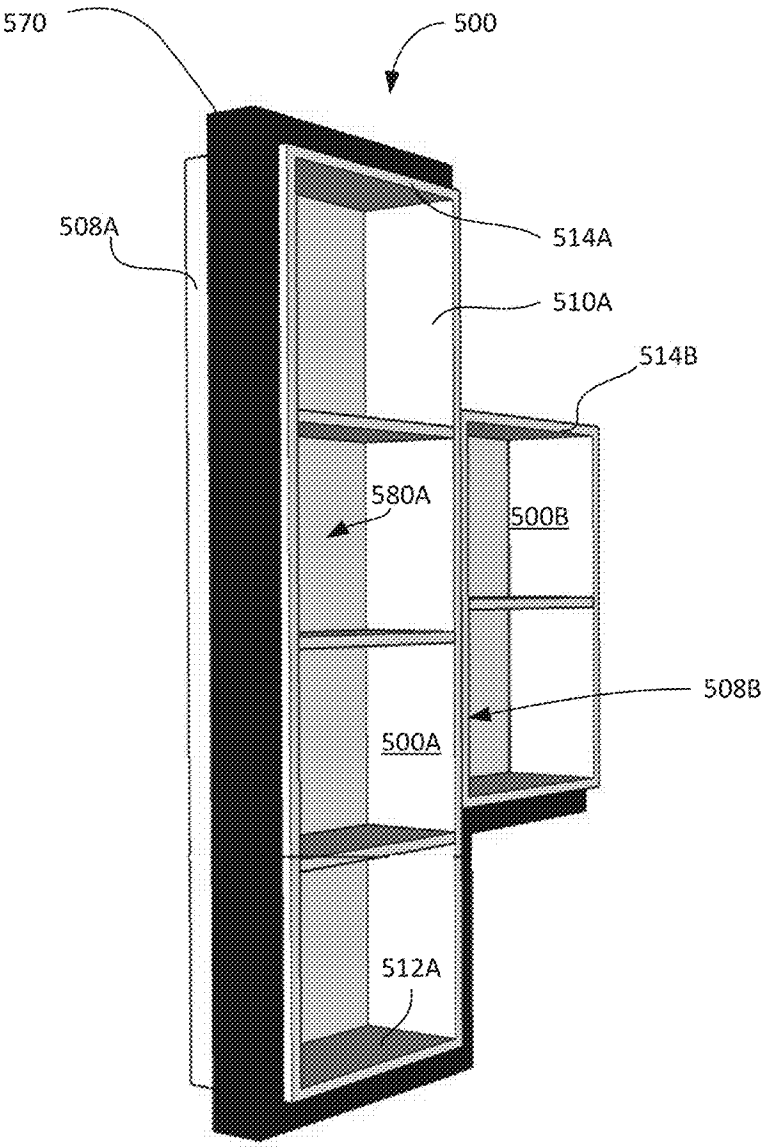

FIGS. 5A, 5B provide two perspective views of a related embodiment 500, in which each of the constituent cases 500A, 500B—in addition to the necessary sidewall panels 508A, 508B, 510A, 510B, bottom panels 512A, 512B and top panels 514A, 514B—has a corresponding (generally optional) back panel (or rear wall) 580A, 580B. Each of these back panels 580A, 580B connects the top, sidewall, and bottom panels of the respective constituent cases 500A, 500B. In at least one implementation, there may be a single back panel which the sub-cases 500A, 500B of the embodiment 500 share. The constituent cases 500A, 500B are explicitly shown to be of different dimensions (height and/or width but not the depth, in this specific example). The frame 570 is chosen, in this case, to support one of the constituent cases (as shown—500A) from the sidewall panel, from above, and from below, and additionally extends to support the other case 500B from the bottom. It is also understood that variations in the shape and positioning of the frame 570 and/or its constituent beams can be varied (for example, by analogy with that described in reference to FIGS. 2A, 2B, 3A, 3B).

As has been already alluded to, the affixation of the frame to the container according to an embodiment of the invention can be generally carried out in several ways that include attachment of the frame (previously assembled from the constituent beams) to the container, attachment of the constituent beams to one another in the process of attachment of the beams to the corresponding panels of the chosen piece of furniture, and an initial formation of a full rigid frame the contour of which is substantially the same as the contour of the chosen piece of furniture that consequently is attached to the chosen piece of furniture (by, for example, sliding the preformed frame onto the piece of furniture, either sideways or from the front or back).

In accordance with non-mutually exclusive and non-limiting examples of embodiments, described with reference to Figures of this disclosure, structures of pieces of furniture are described, as well as a method for putting together (assembly of) such pieces of furniture. It will be understood by those of ordinary skill in the art that modifications to, and variations of, the illustrated embodiments may be made without departing from the inventive concepts disclosed herein. For example, a body of a given piece of furniture (that is juxtaposed with a peripheral frame, such as frames 170, 470, 570) may optionally include not only a back panel but a front panel such as a door providing access to a space limited by the sidewall, top, and bottom panels. Directions along which a given component (beam) of a frame is extending along a corresponding panel of the piece of furniture may be transverse to the directions along which such panel is extending on its own. The affixation of the frame to the body of the piece of furniture may be configured at at least one point or at multiple points along the length of a given portion of the frame. The ratios of various corresponding dimensions of multiple constituent cases of a multi-case embodiment of the invention may differ, as may differ a vertical offset with which one constituent case is juxtaposed with another constituent case (as can be seen from comparison of the embodiments 500 and 400, for example). Materials from which either the body or the frame of a given piece of furniture is fabricated may vary, as known in related art. Understandably, the peripheral frame additionally provides an original and ornamental design for a discussed article of furniture.

For the purposes of this disclosure and the appended claims, the use of the terms "substantially", "approximately", "about" and similar terms in reference to a descriptor of a value, element, property or characteristic at hand is intended to emphasize that the value, element, property, or characteristic referred to, while not necessarily being exactly as stated, would nevertheless be considered, for practical purposes, as stated by a person of skill in the art. These terms, as applied to a specified characteristic or quality descriptor means "mostly", "mainly", "considerably", "by and large", "essentially", "to great or significant extent", "largely but not necessarily wholly the same" such as to reasonably denote language of approximation and describe the specified characteristic or descriptor so that its scope would be understood by a person of ordinary skill in the art. The use of these terms in describing a chosen characteristic or concept neither implies nor provides any basis for indefiniteness and for adding a numerical limitation to the specified characteristic or descriptor. As understood by a skilled artisan, the practical deviation of the exact value or characteristic of such value, element, or property from that stated falls and may vary within a numerical range defined by an experimental measurement error that is typical when using a measurement method accepted in the art for such purposes.

In one specific case, when the terms "approximately", "substantially", and "about" are used in reference to a numerical value, these terms represent a range of plus or minus 20% with respect to the specified value, more preferably plus or minus 10%, even more preferably plus or minus 5%, most preferably plus or minus 2% with respect to the specified value. As a non-limiting example, two values being "substantially equal" to one another implies that the difference between the two values may be within the range of +/−20% of the value itself, preferably within the +/−10% range of the value itself, more preferably within the range of +/−5% of the value itself, and even more preferably within the range of +/−2% or less of the value itself References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment," and similar language throughout this specification may, but do not necessarily, all refer to the same embodiment. It is to be understood that no portion of disclosure, taken on its own and in possible connection with a figure, is intended to provide a complete description of all features of the invention.

Within this specification, embodiments have been described in a way that enables a clear and concise specification to be written, but it is intended and will be appreciated that embodiments may be variously combined or separated without parting from the scope of the invention. In particular, it will be appreciated that all features described herein at applicable to all aspects of the invention. The invention as recited in claims appended to this disclosure is intended to be assessed in light of the disclosure as a whole, including features disclosed in prior art to which reference is made. Disclosed aspects, or portions of these aspects, may be combined in ways not listed above. Accordingly, the invention should not be viewed as being limited to the disclosed embodiment(s).

What is claimed is:

1. A piece of furniture comprising:

a first container including first and second sidewall panels, a main top panel connecting the first and second sidewall panels, a main bottom panel connecting the first and second sidewall panels, an auxiliary container including third and fourth sidewall panels, an auxiliary bottom panel connecting the third sidewall panel with the fourth sidewall panel, and an auxiliary top panel connecting the third sidewall panel with the fourth sidewall panel;

wherein the third sidewall panel is attached to the second sidewall panel along a length of the second sidewall such that at least one of the following conditions is satisfied:

(1a) the main top panel and the auxiliary top panel are at different levels, and (1b) the main bottom panel and the auxiliary bottom panel are at different levels; and a frame including first and second beams connected to one another at first ends of said first and second beams, each of said first and second beams having a corresponding axis and a corresponding polygonal cross-section, wherein the frame is attached to the first container such that the first beam is affixed to the first sidewall panel along a length of the first beam and the second beam is affixed to the main bottom panel along a length of the second beam.

2. The piece of furniture according to claim 1, wherein a first height of the first container is different from a second height of the auxiliary container and both of the conditions (1a) and (1b) are satisfied.

3. The piece of furniture according to claim 1, wherein at least one of the first sidewall panel and the main bottom panel has a substantially rectangular outer surface and a corresponding one of the first and second beams is attached to said substantially rectangular outer surface diagonally.

4. The piece of furniture according to claim 1, wherein the frame further includes a third beam connected to a second end of the first beam and affixed to the main top panel along a length of the third beam.

5. The piece of furniture according to claim 1, wherein a depth of the first container and a depth of the auxiliary container are substantially equal.

6. The piece of furniture according to claim 4, wherein the third and second beams are substantially tangentially parallel to one another and/or axes of the third and second beams are parallel to one another.

7. The piece of furniture according to claim 1, wherein at least one of the following conditions is satisfied:

(7a) the first and second sidewall panels are substantially parallel to one another;

(7b) the main top panel and the main bottom panel are substantially parallel to one another;

(7c) a cross-section of at least one of the first and second beams is a quadrilateral;

(7d) said cross-section is a parallelogram; and (7e) the first and second beams are attached to outside surfaces of the first container.

8. The piece of furniture according to claim 1, wherein at least one of the following conditions is satisfied:

(8a) the piece of furniture is a bookcase; and (8b) the piece of furniture includes a shelf disposed along the main top panel substantially transversely between the first and second sidewall panels;

(8c) the piece of furniture includes a rear wall connecting at least two of the first and second sidewall panels, the main bottom panel, and the main top panel; and (8d) the piece of furniture and at least one of the first and second beams are made of different materials.

9. The piece of furniture according to claim 1, wherein, when the auxiliary bottom panel is separated from the main bottom panel along the second sidewall panel, the frame includes a fourth beam and a fifth beam, a first end of the fourth beam connected to a second end of the second beam and a first end of the fifth beam connected to a second end of the fourth beam, the fourth beam is affixed to the piece of furniture along a length of the fourth beam, the fifth beam is affixed to the auxiliary bottom panel along a length of the fifth beam.

10. The piece of furniture according to claim 1, wherein when the auxiliary bottom panel and the main bottom panel lie in the same plane and the frame is attached to the container, the second beam extends along the auxiliary bottom panel and is affixed to the auxiliary bottom panel along the length of the second beam.

11. The piece of furniture according to claim 9, wherein a width of a beam chosen from the first, second, fourth, and fifth beams is smaller than a width of a surface of the piece of furniture to which said chosen beam is affixed.

12. The piece of furniture according to claim 1, wherein at least one of a first width of the first beam and a second width of the second beam is smaller than, respectively, a width of the first sidewall panel and a width of the main bottom panel.

13. A method for manufacturing a piece of furniture that comprises a first container including first and second sidewall panels, a main top panel connecting the first and second sidewall panels, a main bottom panel connecting the first and second sidewall panels, and an auxiliary container including third and fourth sidewall panels, an auxiliary bottom panel connecting the third sidewall panel with the fourth sidewall panel, and an auxiliary top panel connecting the third sidewall panel with the fourth sidewall panel, wherein the third sidewall panel is attached to the second sidewall panel along a length of the second sidewall such that at least one of the following conditions is satisfied:

(14a) the main top panel and the auxiliary top panel are at different levels, and (14b) the main bottom panel and the auxiliary bottom panel are at different levels, the method comprising:

affixing a first beam, which has a first length and a first polygonal cross-section and a first axis, to and along the first sidewall panel along the first length;

attaching a second beam, which has a second length and a second polygonal cross-section and a second axis, to and along the main bottom panel along the second length; and bringing ends of the first and second beams in contact with one another.

14. The method according to claim 13, wherein said affixing and attaching includes cooperating the first and second beams with an outside surface of a first container to form a first rib substantially in the middle of the first sidewall panel and a second rib substantially in a middle of the main bottom panel to increase a rigidity of the first container.

15. The method according to claim 13, wherein the first container is a bookcase that includes at least one of (17a) a shelf disposed along the main top panel substantially transversely between the first and second sidewall panels; and (17b) a rear wall connecting at least two of the first and second sidewall panels, the main bottom panel, and the main top panel.

16. The method according to claim 13, wherein said bringing the ends of the first and second beams together includes affixing the first and second beams to one another at a substantially right angle.

17. The method according to claim 13, wherein said bringing includes affixing the first and second beams together before said affixing and said attaching.

18. The method according to claim 13, wherein the first and second polygonal cross sections at said ends of the first and second beams are substantially congruent with one another, and wherein said bringing includes affixing the first and second beams to one another along the first and second polygonal cross-sections.

* * * * *